United States Patent [19]

Fukuoka et al.

[11] Patent Number: 4,934,345

[45] Date of Patent: Jun. 19, 1990

[54] TWO-CYCLE INTERNAL COMBUSTION ENGINE

[75] Inventors: Takashi Fukuoka, Fuchu; Mitsujiro Mochizuka, Tokyo; Masakuni Hiroshima, Sagamihara, all of Japan

[73] Assignee: Kioritz Corporation, Tokyo, Japan

[21] Appl. No.: 351,503

[22] Filed: May 15, 1989

[30] Foreign Application Priority Data

May 26, 1988 [JP] Japan ..... 63-69766[U]

[51] Int. Cl.[5] ..... F02B 33/04

[52] U.S. Cl. ..... 123/73 AA; 123/73 PP

[58] Field of Search ..... 123/47 A, 73 AA, 73 FA, 123/73 PP, 73 R, 65 A

[56] References Cited

U.S. PATENT DOCUMENTS

| | | | |
|---|---|---|---|
| 1,423,578 | 7/1922 | Neighbour et al. | 123/73 AA |
| 3,797,467 | 3/1974 | Tenney | 123/73 AA |
| 4,000,723 | 1/1977 | Boyesen | 123/73 AA |
| 4,135,479 | 1/1979 | Reitz et al. | 123/73 AA |
| 4,195,600 | 4/1980 | Shingai | 123/73 AA |
| 4,329,948 | 5/1982 | Fujikawa et al. | 123/73 AA |
| 4,395,978 | 8/1983 | Boyesen | 123/73 AA |

FOREIGN PATENT DOCUMENTS

| | | | |
|---|---|---|---|
| 1361336 | 4/1964 | France . | |
| 214687 | 5/1941 | Switzerland | 123/73 AA |
| 522682 | 6/1940 | United Kingdom | 123/73 AA |

*Primary Examiner*—David A. Okonsky

*Attorney, Agent, or Firm*—Browdy and Neimark

[57] ABSTRACT

A two-cycle internal combustion engine comprising a cylinder including an exhaust outlet and scavenging paths formed in the inner wall thereof, and a piston including openings formed in its peripheral wall at positions near respective piston-pin bosses thereof, the respective upper ends of the scavenging paths serving as scavenging ports which are opened and closed through reciprocating movement of the piston and the openings being so arranged as to communicate with the scavenging paths at positions nearer to the exhaust outlet of the cylinder.

5 Claims, 3 Drawing Sheets

TWO-CYCLE INTERNAL COMBUSTION ENGINE

BACKGROUND OF THE INVENTION

This invention relates to a two-cycle internal combustion engine.

In a conventional two-cycle engine of the crank chamber pre-compressing type, scavenging paths extend along the inner wall of the cylinder as well as into the crankcase, the upper ends of the scavenging paths serving as scavenging ports which are opened and closed through reciprocating movement of the piston. Openings are provided in the peripheral wall of the piston at positions near the piston-pin bosses thereof in such a manner as to allow them to normally communicate with the scavenging paths during scavenging, air-fuel mixture being conveyed to the scavenging ports by way of the outer route through the scavenging paths and the inner route extending through the inner space of the piston. In a conventional engine with the above construction, the openings provided in the peripheral surface of the piston are formed as relatively large openings which are symmetrically arranged with respect to the piston-pin bosses, i.e., one on the side of the suction inlet and the other on the side of the exhaust outlet. Because of this, the flow which occurs within the piston during scavenging stroke is rather weak, so that a back flow running backward to the scavenging flow, i.e., a pulsating flow is likely to be generated therein. This is especially the case during a low-speed operation such as idling. Such a pulsating flow may be the cause of irregular combustion, resulting in variations in the rotational speed of the engine, insufficient cooling of the piston, etc.

SUMMARY OF THE INVENTION

It is accordingly an object of this invention to provide a two cycle internal combustion engine which is free from the above-mentioned problem encountered in the prior art and which is simple in structure and convenient for use.

In accordance with this invention, there is provided a two-cycle internal combustion engine in which the above mentioned openings formed in the peripheral wall of the piston are so arranged that they communicate with the above-mentioned scavenging paths at positions nearer to the exhaust outlet of the cylinder.

Fresh air entering the inner space of the piston flows vigorously into the scavenging paths, throttled by the openings which are arranged in the peripheral wall of the piston at positions nearer to the exhaust outlet of the cylinder. This enhances the cooling effect provided by fresh air, makes the distribution of the piston temperature even, and heightens the scavenging pressure entering into the secondary compression side, thereby preventing generation of any back flow and improving the scavenging efficiency. With respect to the output performance, this arrangement makes it possible to shift the torque peak to the low speed side and to lessen variations in the rotational speed of the engine in the low speed range.

DETAILED DESCRIPTION OF THE PREFERRED EMBODIMENT

An embodiment of this invention will now be described with reference to the accompanying drawings.

The embodiment is shown as applied to an air-cooled two-cycle internal combustion engine used in a portable working machine such as a chain saw. Rotation of a crankshaft 1 provided in the engine drives a working tool such as a saw chain (not shown). The crankshaft 1 is rotated by reciprocating movement of a piston 3 arranged in a cylinder 2, through a connecting rod 4.

Figure 1:
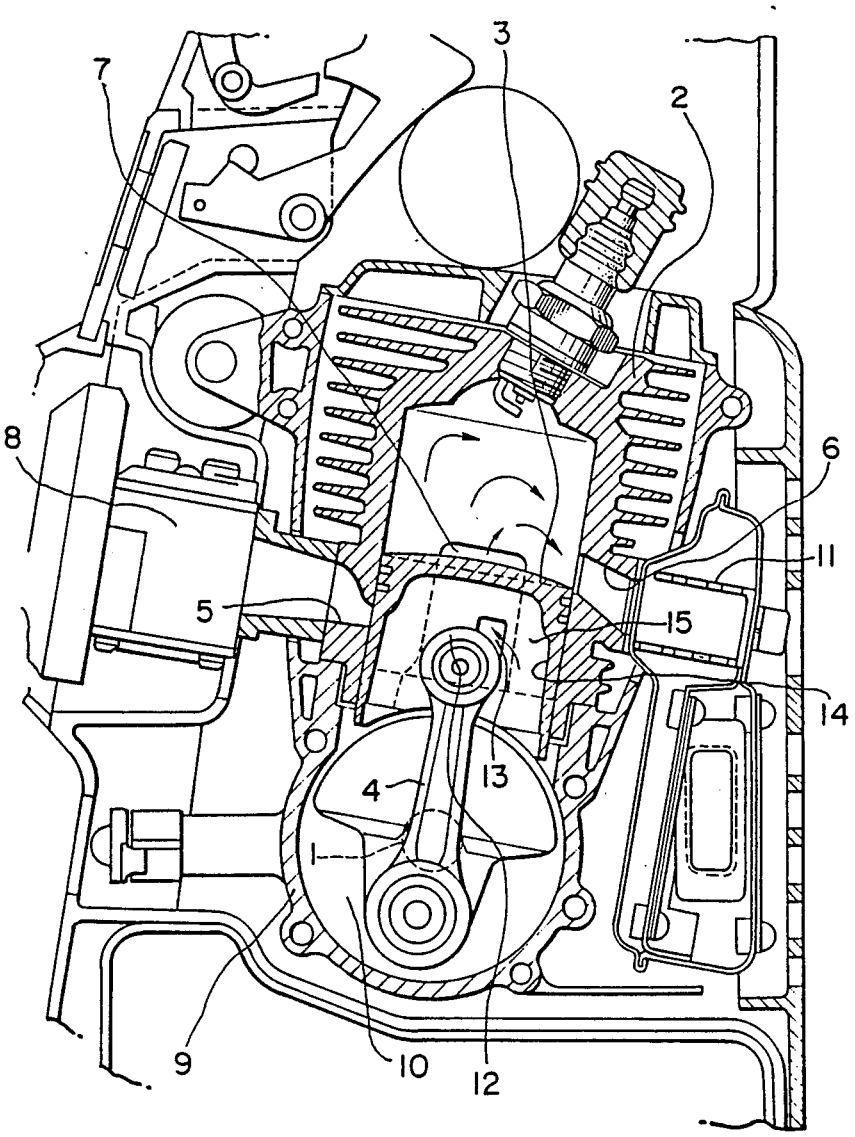
FIG. 1 is a side elevational view, partly in section, of an embodiment of a two-cycle internal combustion engine in accordance with this invention.
Figure 2:
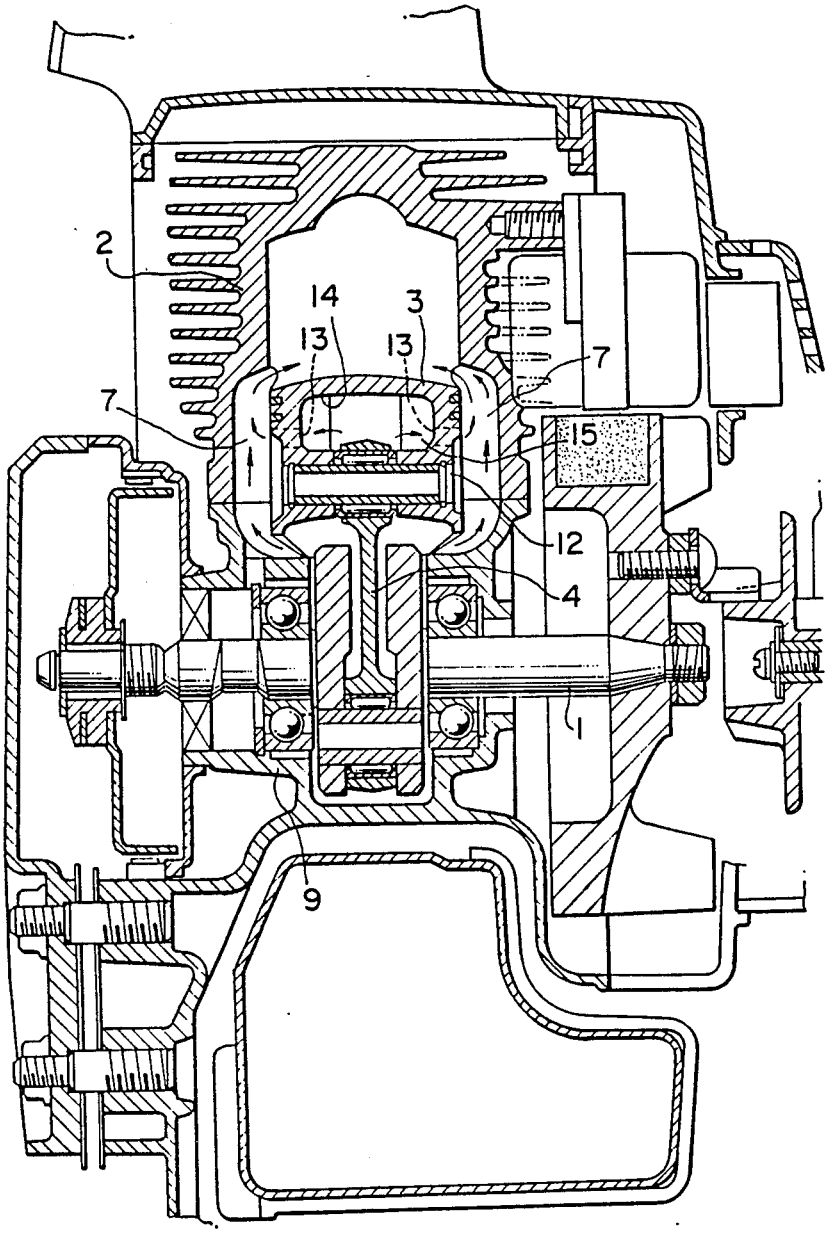
FIG. 2 is a longitudinal sectional view thereof.

As shown in FIG. 1, the above-mentioned cylinder 2 includes a suction inlet 5 provided in the side wall thereof. The cylinder 2 also includes an exhaust outlet 6 provided in that section of the side wall thereof which is opposite to the suction inlet 5. Further, as shown in FIG. 2, the cylinder 2 includes a pair of scavenging paths 7 serving as the outer paths, which are provided in the side wall thereof at positions angularly spaced apart from the suction inlet 5 and the exhaust outlet 6, respectively, by ca. 90° . The suction inlet 5 is so designed that, during the compression stroke of the piston 3, air-fuel mixture from a carburetor 8 is introduced into a crank chamber 10 of a crankcase 9, and is pre-compressed in the crank chamber 10. During the expansion stroke of the piston 3, the exhaust outlet 6 allows the combustion gas in the cylinder 2 to escape through a muffler 11. The above-mentioned scavenging paths 7 extend along the inner wall of the cylinder 2 as well as into the crankcase 9, the respective upper sections of the scavenging paths 7 serving as scavenging ports which are opened and closed through vertically reciprocating movement of the piston 3.

Figure 3:
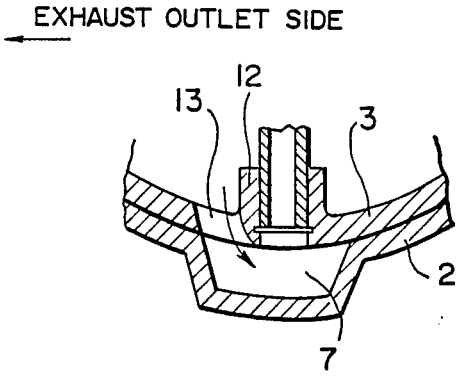
FIG. 3 is a sectional view of a part of the engine shown in FIG. 1.

As shown in FIG. 3, a pair of openings 13 are provided in the peripheral surface of the piston 3 at positions near piston-pin bosses 12. These openings 13 form an inner path 15 which allows an inner space 14 of the piston 3 to normally communicate with the respective scavenging paths 7. It is to be noted that these two openings 13 are respectively arranged at positions nearer to the exhaust outlet 6 with respect to the scavenging paths 7 (see FIGS. 1 and 3). Because of this arrangement, fresh air which has been pre-compressed in the crank chamber 10 flows therefrom, during scavenging, directly into the scavenging paths 7. At the same time, it flows by way of the inner space 14 of the piston 3 to the scavenging paths 7 through the openings 13 arranged nearer to the exhaust outlet 6, and from there vigorously flows into the cylinder 2, throttled by the openings 13. Accordingly, the piston 3 can be effectively cooled from the exhaust side, which is at a higher temperature. Furthermore, it helps to heighten the scavenging pressure entering into the secondary compression side, thereby preventing generation of any back flow and improving the scavenging efficiency.

What is claimed is:

1. A two-cycle internal combustion engine comprising a crankcase, a cylinder including an exhaust outlet and at least one scavenging path formed in the inner wall thereof extending into said crankcase via a respective lower end entrance port, each said scavenging path having a central longitudinal axis, and a piston including at least one opening formed in its peripheral wall at a position near respective piston-pin bosses thereof, the upper end of each said scavenging path serving as a scavenging port which is opened and closed through reciprocating movement of said piston and each said opening in said piston forming at least in part a flow path to a respective said scavenging path at a time when the respective lower end entrance port is in communication with said crankcase, each said opening being arranged to one side of the respective longitudinal axis at a position nearer to the exhaust outlet of the cylinder.

2. A two-cycle internal combustion engine of claim 1 wherein said scavenging paths are separated by substantially 180° from each other.

3. A two-cycle internal combustion engine of claim 2 wherein said scavenging paths are each separated by substantially 90° from said exhaust outlet.

4. A two-cycle internal combustion engine of claim 1 wherein said piston openings are located on said piston where said openings cover less than the entire radial width of said scavenging paths.

5. A two-cycle internal combustion engine as set forth claim 4 wherein said piston opening which provide open and closed scavenging ports provide additional flow to said scavenging path over that which is provided by said opening formed by scavenging paths which extend into said crank case.

* * * * *